US009400130B2

(12) United States Patent
Smith

(10) Patent No.: US 9,400,130 B2
(45) Date of Patent: Jul. 26, 2016

(54) SKATING RINK MARKINGS AND RELATED METHODS

(71) Applicant: The Thomas E. Smith Fight to Cure Paralysis Foundation, Swampscott, MA (US)

(72) Inventor: Thomas E. Smith, Swampscott, MA (US)

(73) Assignee: The Thomas E. Smith Fight to Cure Paralysis Foundation, Swampscott, MA (US)

( * ) Notice: Subject to any disclaimer, the term of this patent is extended or adjusted under 35 U.S.C. 154(b) by 0 days.

(21) Appl. No.: 14/926,043

(22) Filed: Oct. 29, 2015

(65) Prior Publication Data

US 2016/0047585 A1 Feb. 18, 2016

Related U.S. Application Data

(63) Continuation of application No. 14/189,435, filed on Feb. 25, 2014, now Pat. No. 9,194,621.

(51) Int. Cl.

| | |
|---|---|
| ***A63C 19/06*** | (2006.01) |
| ***F25C 3/02*** | (2006.01) |
| ***A63C 19/10*** | (2006.01) |

(52) U.S. Cl.

CPC ..... *F25C 3/02* (2013.01); *A63C 19/065* (2013.01); *A63C 19/10* (2013.01)

(58) Field of Classification Search

CPC ..... A63C 17/00; A63C 19/00; A63C 19/06; A63C 19/10; E01C 13/00; E01C 13/02; E01C 13/08; E01C 13/045

USPC ..... 472/88, 90, 92, 94

See application file for complete search history.

(56) References Cited

U.S. PATENT DOCUMENTS

| | | | | |
|---|---|---|---|---|
| 2,587,855 | A | 3/1952 | Johnson | |
| 2,665,561 | A | 1/1954 | Yocum | |
| 5,127,164 | A | 7/1992 | Belcourt et al. | |
| 5,188,700 | A | 2/1993 | Gilkes | |
| 5,312,109 | A | 5/1994 | Cagle | |
| 5,478,393 | A | 12/1995 | Vacanti | |
| 5,897,438 | A * | 4/1999 | Kunz | A63C 19/00 472/90 |
| 5,938,991 | A | 8/1999 | Pollock | |

(Continued)

FOREIGN PATENT DOCUMENTS

| | | |
|---|---|---|
| DE | 10 2005 059 076 A1 | 8/2006 |
| EP | 0 493 354 | 7/1992 |
| WO | WO 98/57713 | 12/1998 |
| WO | WO 2008/088796 | 7/2008 |

OTHER PUBLICATIONS

"A line in the ice for hockey safety", The Boston Globe dated Jan. 2, 2014 (1 page) See: http://www.bostonglobe.com/opinion/editorials/2014/01/02/look-line-hockey-player-tom-smith-lays-down-marker-for-safety/b143MRsFh0ha24scgL8o4J/story.html.

(Continued)

*Primary Examiner* — Kien Nguyen

(74) *Attorney, Agent, or Firm* — Fish & Richardson P.C.

(57) ABSTRACT

This disclosure relates to a skating rink that includes a skating area, a wall at least partially surrounding the skating area, and a visible mark extending along a perimeter region of the skating area to indicate to a skater traveling head first toward the wall that the skater should look up and to related methods.

32 Claims, 5 Drawing Sheets

(56) References Cited

U.S. PATENT DOCUMENTS

| | | | | |
|---|---|---|---|---|
| 5,993,335 | A | 11/1999 | Eden et al. | |
| 6,053,426 | A | 4/2000 | Robinson et al. | |
| 6,093,109 | A * | 7/2000 | Eden | A63C 19/10 472/90 |
| 2005/0235908 | A1 | 10/2005 | Loverock | |

OTHER PUBLICATIONS

"Frozen Fenway a new home for Look-Up Line", The Boston Globe dated Dec. 30, 2013 (5 pages) See: http://www.bostonglobe.com/sports/2013/12/30/tom-smith-look-line-hopes-prevent-catastrophic-hockey-injuries-along-boards/hAo3JvoDyU3vd6S3RM8PaK/story.html.

"Look-Up Line™ sparks debate on NESN", downloaded on Jan. 21, 2014 (2 pages) See: http://justcureparalysis.org/look-up-line-sparks-debate/.

"Preventing Hockey Injuries: Could an Orange Line Help?", Here & Now dated Jan. 6, 2014 (11 pages) See: http://hereandnow.wbur.org/2014/01/06/hockey-injuries-line.

"Tom Smith's 'Look-Up Line' Serves as Hockey's Warning Track, Could Prevent Collisions Along Boards (Video)", dated Jan. 7, 2014 (17 pages) See: http://nesn.com/2014/01/tom-smiths-look-up-line-serves-as-hockeys-own-warning-track-h.

* cited by examiner

SKATING RINK MARKINGS AND RELATED METHODS

CROSS-REFERENCE TO RELATED APPLICATION

This application is a continuation of U.S. application Ser. No. 14/189,435, filed on Feb. 25, 2014. The above-noted application is incorporated herein by reference in its entirety.

TECHNICAL FIELD

This disclosure relates to skating rink markings and related methods.

BACKGROUND

Skating rinks typically include a skating area surrounded by a wall (often referred to as the boards or dashers). One hazard that skaters face when skating is falling or sliding into the wall at a high speed. This is especially true for skaters participating in contact sports, such as hockey. Falling or sliding head first into the boards can lead to serious injury, including paralysis.

SUMMARY

In one aspect of the invention, a skating rink includes a skating area having a perimeter region and a central region. A wall at least partially surrounds the skating area, and a visible mark extends along the perimeter region of the skating area and substantially surrounds the central region. An inner edge of the visible mark is spaced inwardly from the wall by at least 12 inches to prompt a skater traveling head first toward the wall to look up.

In another aspect of the invention, a method of preparing a skating area of a skating rink includes applying a visible mark to a perimeter region of the skating area that substantially surrounds a central region of the skating area such that an inner edge of the visible mark is inwardly spaced from a wall surrounding the skating area by at least 12 inches to prompt a skater traveling head first toward the wall to look up.

In an additional aspect of the invention, a method includes travelling head first toward a wall of a skating rink, seeing a visible mark that extends along a perimeter region of a skating area of the skating rink and that substantially surrounds a central region of the skating area, and upon seeing the visible mark, looking up to contact the wall in a face first manner.

Implementations can include one or more of the following features.

In some implementations, the skating area includes a frozen liquid.

In certain implementations, the frozen liquid includes ice.

In some implementations, the skating area includes multiple layers of the frozen liquid and the visible mark is positioned between adjacent layers of the frozen liquid.

In certain implementations, the inner edge of the visible mark is spaced inwardly from the wall by 30 inches to 45 inches.

In some implementations, the inner edge of the visible mark is spaced inwardly from the wall by no more than 132 inches (e.g., 40 inches to 132 inches).

In certain implementations, an outer edge of the visible mark is located no more than 35 inches from the wall.

In some implementations, the outer edge of the visible mark is located no more than 6 inches from the wall.

In certain implementations, the visible mark has a width of 12 inches to 45 inches. In some implementations, the visible mark has a width of 12 inches.

In certain implementations, the visible mark has a width of 40 inches.

In some implementations, the visible mark has a width of at least 80 inches (e.g., 80 inches to 132 inches).

In certain implementations, the visible mark is orange.

In some implementations, the visible mark has a color of Pantone 1505C, Pantone 151C, or Pantone 1585C.

In certain implementations, the visible mark has a color of Pantone 151C.

In some implementations, the central region of the skating area is white.

In certain implementations, the visible mark includes a series of segments that are spaced apart about the perimeter region of the skating area.

In some implementations, the visible mark is in the form of a rectangle having rounded corners.

In certain implementations, the visible mark includes paint.

In some implementations, the visible mark includes colored tape.

In certain implementations, the visible mark includes one or more logos.

In some implementations, the visible mark includes text.

In certain implementations, the text reads at least in part Look Up.

In some implementations, the skating area includes a plurality of lines that overlap the visible mark, the plurality of lines being visible over the visible mark.

In certain implementations, the skating area includes a plurality of face off circles from which hash marks extend, the visible mark being positioned such that the visible mark does not overlap any portion of the plurality of face off circles or the hash marks.

In some implementations, applying the visible mark to the perimeter region of the skating area includes applying a colored mark to a frozen liquid.

In certain implementations, applying the colored mark includes painting the frozen liquid.

In some implementations, applying the colored mark includes applying a colored tape to the frozen liquid.

In certain implementations, the method of preparing the skating area further includes applying a layer of liquid over the colored mark and freezing the liquid.

In some implementations, the method of preparing the skating area further includes applying a white material to the central region of the skating area.

In certain implementations, the white material includes paint.

In some implementations, applying the visible mark to the perimeter region of the skating area includes applying a series of segments to the perimeter region of the skating area, the segments being spaced apart about the perimeter region of the skating area.

In certain implementations, the visible mark is applied to the perimeter region of the skating area in the form of a rectangle having rounded corners.

In some implementations, the visible mark is in the form of a rectangle having rounded corners.

In certain implementations, the method of preparing the skating area further includes applying to the skating area a plurality of lines in a manner such that the plurality of lines overlap the visible mark and are visible over the visible mark.

In some implementations, the method of preparing the skating area further includes applying to the skating area a plurality of face off circles from which hash marks extend, the visible mark being positioned such that the visible mark does not overlap any portion of the plurality of face off circles or the hash marks.

In certain implementations, the method further includes receiving instructions to look up upon seeing the visible mark when travelling head first toward the wall.

In some implementations, the instructions are received prior to entering the skating area of the skating rink.

Implementations can include one or more of the following advantages.

In certain implementations, the visible mark extending along the perimeter region of the skating area is positioned a sufficient distance from the wall to allow a skater travelling head first toward the wall, upon seeing the visible mark, to look up prior to impact with the wall. Looking up in this way causes the player to impact the wall with his or her face (or face mask) rather than the top of his or her head (or helmet), which somewhat counter intuitively can reduce the risk of serious injury, such as paralysis. Impacting the wall face first in this manner permits the force of the impact to be absorbed by a backward bending motion of the skater's neck. As a result, the skater is less likely to experience a compression fracture in his or her spine. Such compression fractures, which can lead to spinal cord damage and paralysis, are much more likely to occur as a result of a head first impact with the wall than a face first impact with the wall.

In certain implementations, the visible mark extending along the perimeter region of the skating area is orange. It has been found, in cases in which the skating area is an ice surface, that the orange color provides good visibility for the mark even as snow accumulates on the ice surface. In addition, since none of the skating area markings required by hockey regulations (e.g., lines, face-off circles, face-off dots, goal crease, etc.) are orange, the visible mark extending around the perimeter of the skating area will stand out to the skater and will have minimal impact on the game. Further, because orange is a universal color for representing danger, the orange visible mark works particularly well to warn skaters of a potential dangerous impact with the wall and to remind the skaters to look up upon seeing the marking.

In addition to serving as an indication to a skater travelling head first into the boards that the skater should look up, the visible mark extending along the perimeter region of the skating area can also remind players to use caution in the vicinity of the visible marking. As an example, the visible marking can serve as a warning to avoid checking players from behind or engaging in other dangerous behavior that can lead to a player travelling head first into the wall within the perimeter region of the skating area in which the visible mark is located. Reducing checks from behind and other dangerous behavior in this manner can reduce the number of head first impacts that players experience and can thus reduce the number of serious injuries that occur.

Other aspects, features, and advantages will be apparent from the description and drawings, and from the claims.

DETAILED DESCRIPTION

Figure 1:
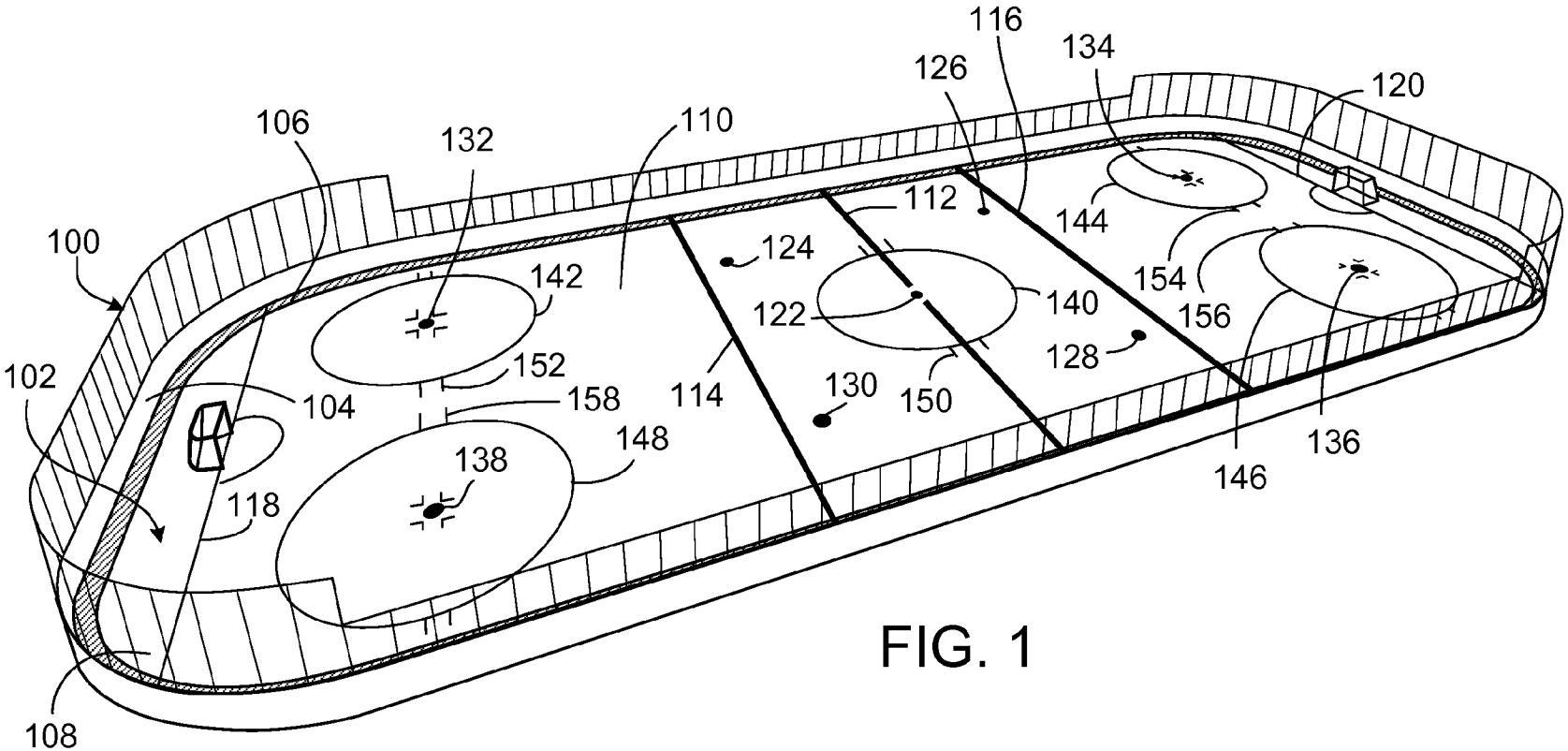
FIG. 1 is a perspective view of a skating rink having a skating area surrounded by a wall and a painted line extending around a perimeter region of the skating area.
Figure 2:
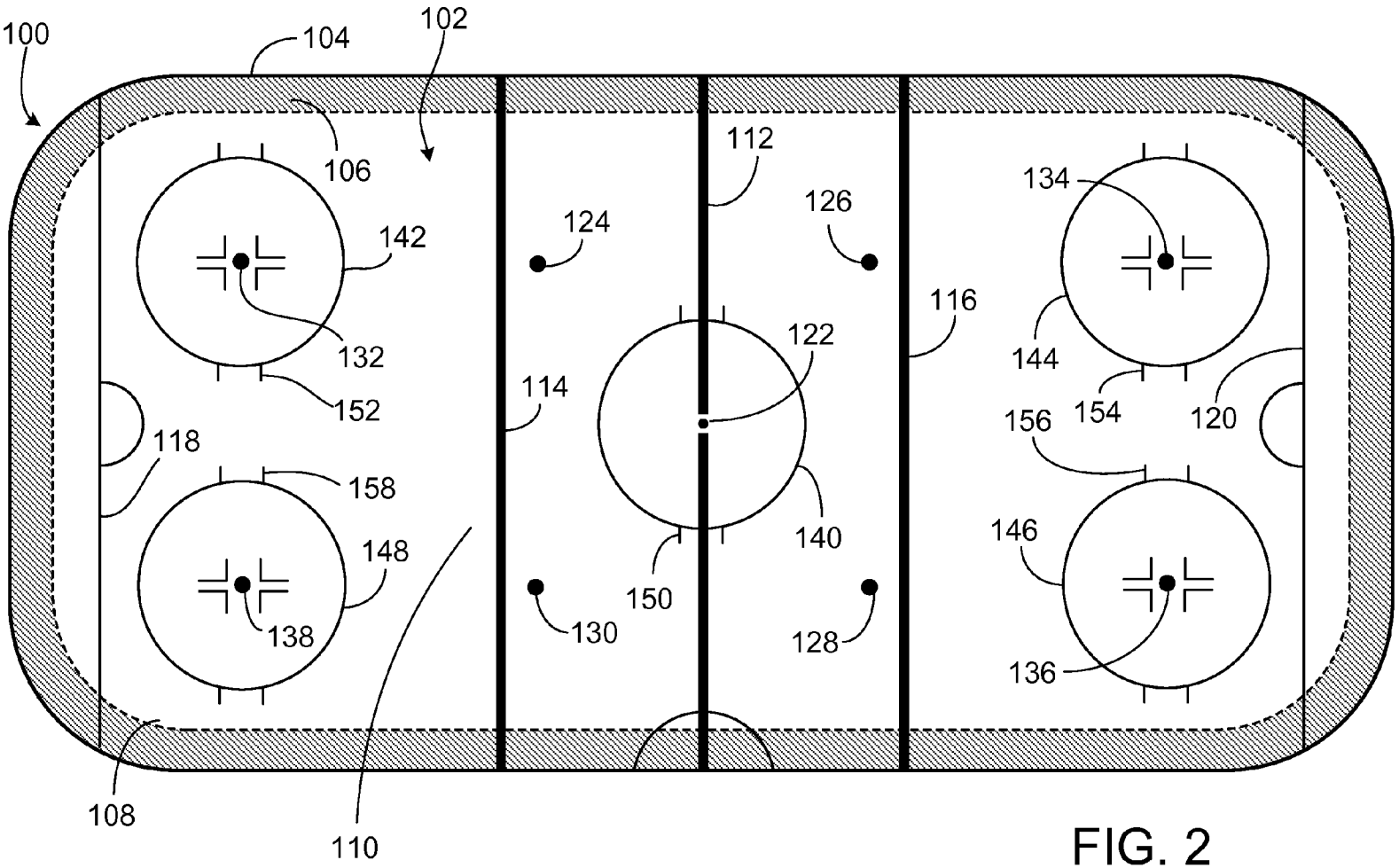
FIG. 2 is a plan view of the skating rink of FIG. 1.

FIGS. 1 and 2 are perspective and plan views, respectively, of a skating rink 100 that includes a skating area (also referred to as a skating surface) 102 surrounded by a wall (also referred to as boards or dashers) 104. A painted area (referred to herein as a line) 106 extends around a perimeter region 108 of the skating area 102 such that the line 106 surrounds a central region 110 of the skating area 102. The line 106 serves as an indicator for a skater travelling head first toward the wall 104 to pick up his or her head prior to impacting the wall 104. As explained below, impacting the boards in this way can reduce the risk of serious injury, such as fractured vertebrae, which can cause paralysis.

Still referring to FIGS. 1 and 2, in addition to the line 106, the skating area 102 includes various other markings that are typical of a skating rink on which hockey is played. A red line 112 extends across the width of the ice at a midway point along the length of the skating area 102. Blue lines 114, 116 extend across the width of the skating area 102 on either side of the red line 112, and goal lines 118, 120 extend across the width of the skating area 102 in opposite end regions of the skating area 102. A face-off dot 122 is positioned halfway across the red line 112. Other face-off dots 124, 126, 128, 130 are located between the red line 112 and the blue lines 114, 116 in the central region 110 of the skating area 102. In addition, face-off dots 132, 134, 136, 138 are located in the four corner regions of the skating area 102. The center face-off dot 122 located along the red line 112 and the face-off dots 132, 134, 136, 138 located in the corner regions of the skating area 102 are surrounded by face-off circles 140, 142, 144, 146, 148. Hash marks 150, 152, 154, 156, 158 extend inwardly and outwardly from the face-off circles 140, 142, 144, 146, 148.

The red line 112, blue lines 114, 116, and goal lines 118, 120 are visible markings that permit players and officials to determine whether certain rule infractions, such as icing and off-sides, have occurred. The face-off dots 122, 124, 126, 128, 130, 132, 134, 136, 138 are visible markings indicating where the puck is to be dropped during face-offs. The face-off circles 140, 142, 144, 146, 148 and hash marks 150, 152, 154, 156, 158 are visible markings that indicate where on the skating area 102 the players are allowed to position themselves during face-offs.

As will be described in greater detail below, the various markings discussed above are typically painted onto a layer of ice and then covered with one or more additional layers of ice. The ice overlying the markings is sufficiently thin to allow the markings to remain visible through that overlying ice. White paint is typically applied to the ice prior to painting the markings to provide the ice surface with a brighter appearance.

The line 106, as illustrated in FIGS. 1 and 2, is a solid painted area that extends from the inner edge of the line 106 to the wall 104 in the general shape of a rectangle with rounded corners (also referred to herein as a ring) along the perimeter region 108 of the skating area 102. The inner edge of the line 106 is located a sufficient distance inwardly from the wall 104 to provide adequate warning for a skater falling or sliding toward the wall 104 (at typical speeds reached while playing hockey) to pick up his or her head before impacting the wall 104. The inner edge of the line 106 can, for example, be located 30 inches to 42 inches (e.g., 40 inches) from the wall 104. This has been found to be a sufficient distance from the board to adequately provide the above-described function discussed above while also minimally interfering with other markings on the skating area. The outer hash marks 152, 154, 156, 158 of the face off circles 142, 144, 146, 148, for example, typically terminate about 43 inches from the wall 104. A gap remains between the inner edge of the line 106 and the outer edges of those hash marks 152, 154, 156, 158. Because the line 106 extends along the entire perimeter region 108 of the skating area 102, a skater will be alerted to an impending impact with the wall 104 regardless of his or her location along the perimeter region 108 of the skating area 102.

The line 106 is typically colored to sharply contrast with the adjacent ice surface, which is generally white. The line 106 can, for example, be a shade of orange, such as Pantone 1505C, Pantone 151C, or Pantone 1585C. In some implementations, the line 106 is the color Pantone 151C. It has been found that colors within the Pantone range noted above tend to remain visible even after the ice overlying the line 116 becomes chopped up and covered with snow from normal wear and tear. In addition to the benefits noted above, making the line 106 orange reduces or minimizes interference with playing and officiating of the game since none of the skating rink marking required by hockey regulations are orange. Orange also is universally associated with danger or warnings and thus serves as a particularly suitable color to alert skaters to an impending collision with the wall 104.

The wall 104 is a relatively rigid assembly that provides a boundary around the perimeter of the skating area 102 for ensuring that skaters and hockey pucks remain inside the skating rink 100. The wall 104 is typically constructed of wood boards that are fastened to the ground and covered by fiberglass panels. The fiberglass panels can provide a slight dampening or absorption effect when struck by hockey pucks. The wall 104 as a whole, however, is sufficiently rigid to withstand high force impacts, such as those caused by skaters being checked into the boards.

Figure 3A:
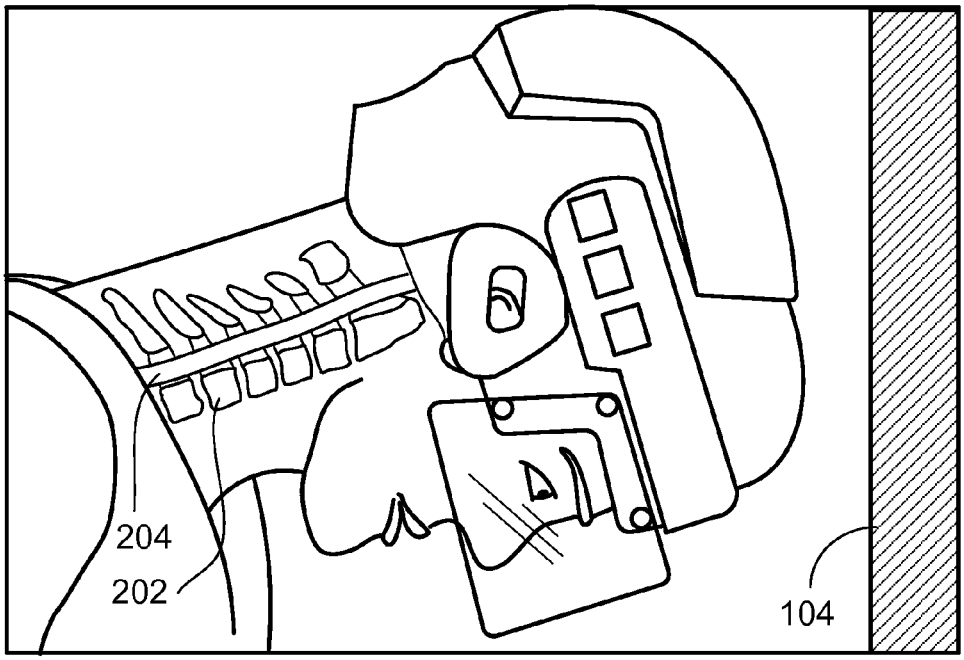
FIGS. 3A and 3B schematically illustrate a hockey player impacting the wall of the skating rink of FIG. 1 in a head-first manner (i.e., without having looked up), resulting in a fractured spine.
Figure 3B:
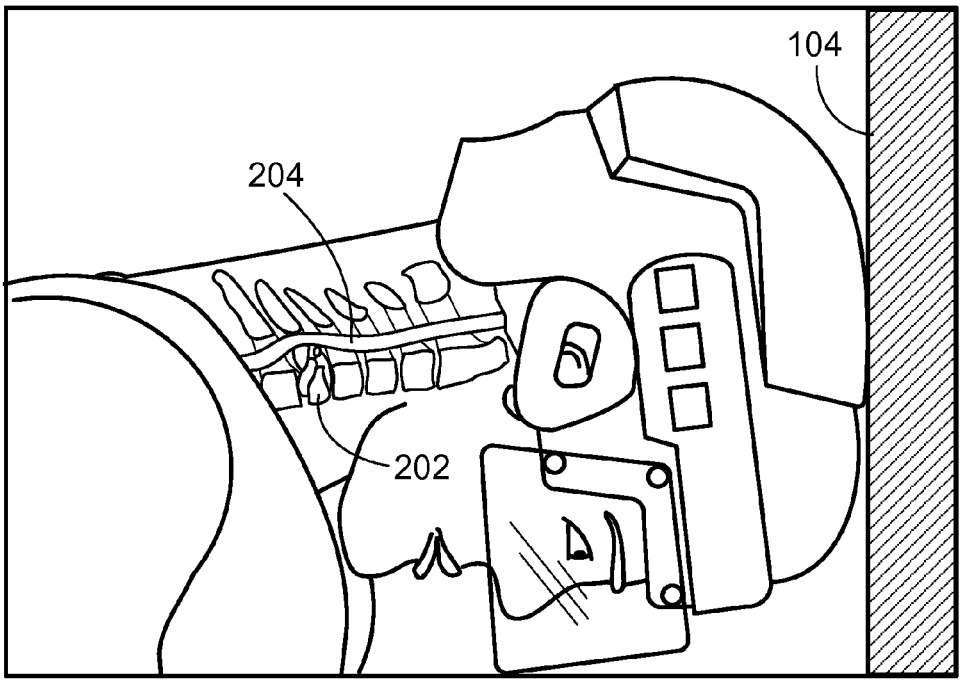

Due to the rigidity of the wall 104, skaters can experience serious injury upon falling or sliding into the wall 104. As an example, skaters who slide into the wall head first can suffer compression fractures in their spines, which can cause spinal cord damage and result in paralysis. FIGS. 3A and 3B illustrate such an event. As shown in FIG. 3A, a hockey player is travelling head first toward the wall 104. This often happens when players are checked from behind in the perimeter region 108 of the skating area 102. Referring to FIG. 3B, the player is impacting the wall 104 in a head first manner. Due to the force of the impact, the player's spine compresses causing a vertebra 202 to fracture and sever his or her spinal cord 204. This type of injury can cause complete or partial paralysis.

The inventor of the concepts being claimed in this patent application understands all too well the dangers associated with impacting the wall of a skating rink in the head first manner illustrated in FIG. 3B. In 2008, he suffered a fractured vertebra and was paralyzed as a result of a head first impact with the wall of a skating rink. After making a full recovery, he returned to the skating rink in 2009 and, as a result of another head first impact with the wall, he again fractured a vertebra, which caused paralysis. It has since become his mission to prevent other skaters from experiencing such injuries. The introduction of the line 116 described herein is one way in which he is doing that.

The line 116 illustrated in FIGS. 1 and 2 is intended to reduce the occurrence of players travelling head first into the wall 104 and thereby reduce the number of serious injuries resulting from such impacts. To do this, players are first educated about the dangers of impacting the wall 104 in a head first manner and are taught to look up prior to impacting the wall 104. Although it may seem counter intuitive to players, they are taught that impacting the wall 104 in a face first manner (as opposed to a head first manner) can reduce the risk of serious injury. Any of various techniques can be used to teach skaters to look up upon seeing the line 106. In some cases, for example, an organization, such as USA Hockey, can hold coaching clinics during which hockey coaches are educated about the seriousness of head first impacts and introduced to the line 116 and its benefits. The coaches can then disseminate this information to their players.

The importance of avoiding head first impacts with the wall 104 can also be conveyed to players through various different publicity campaigns. For example, posters showing the line 116 and instructing skaters to look up to avoid head first impacts with the wall 104 can be placed in skating rinks Additionally, video messages providing this information can be displayed on scoreboard screens during hockey games and can be aired during broadcasts of hockey games to get the message out.

Coupled with the above-described educational programs and publicity campaigns, the mere presence of the line 116 extending along the perimeter region 108 of the skating area 102 will serve as a constant reminder of the importance of avoiding head first impacts with the wall 104. The hope is that through these educational programs and publicity campaigns, it will become second nature for players to look up prior to impacting the wall 104 in order to avoid head first impacts just as it is second nature for players to hold up at the blue line until the puck crosses the blue line to avoid an off-sides call, to cross the red line before dumping the puck into the opponent's zone to avoid an icing call, etc. It is believed that, due to the counter intuitiveness of looking up to impact the wall 104 face first, the reminder to look up provided by the line 106 can greatly reduce the number of head first impacts that occur and can reduce the number of tragic injuries that result from such impacts.

The line 116 helps to prevent serious injuries to hockey players in a couple different ways. First, the line 116 provides players with a highly visible reference near the wall 104 to ensure that a player travelling toward the wall 104 in the perimeter region 108 of the skating area 102 will know that an impact with the wall 104 is imminent. In addition, in those hectic seconds or split-seconds leading up to an impact with the wall 104, the sight of the line 116 will trigger an automatic reaction by the player, resulting from the safety education that the player received, to look up immediately.

Figure 4A:
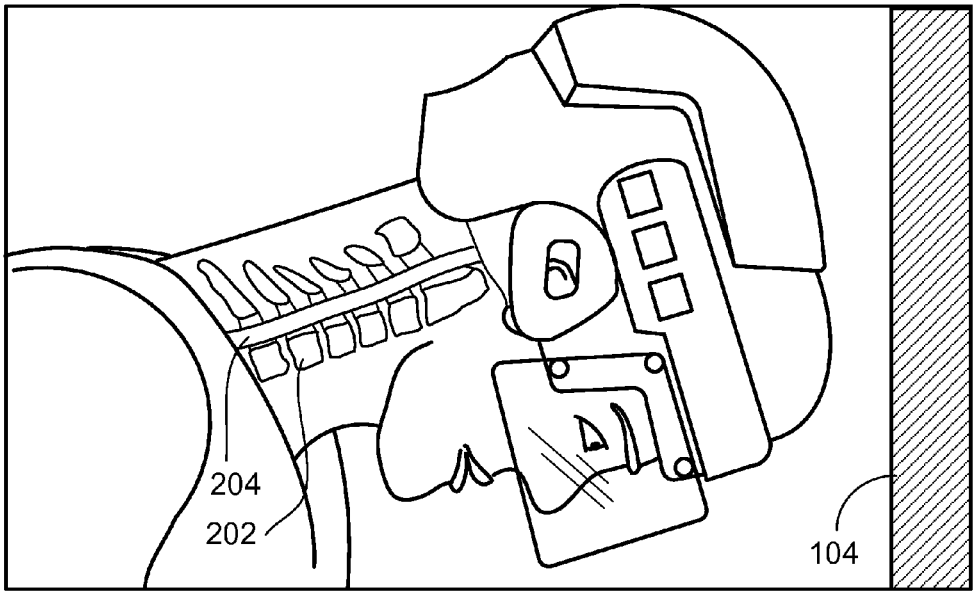
FIGS. 4A-4C schematically illustrate a hockey player impacting the wall of the skating rink of FIG. 1 in a face-first manner (i.e., after having looked up) such that the impact is absorbed by the neck of the hockey player bending backward, thereby avoiding serious injury.
Figure 4B:
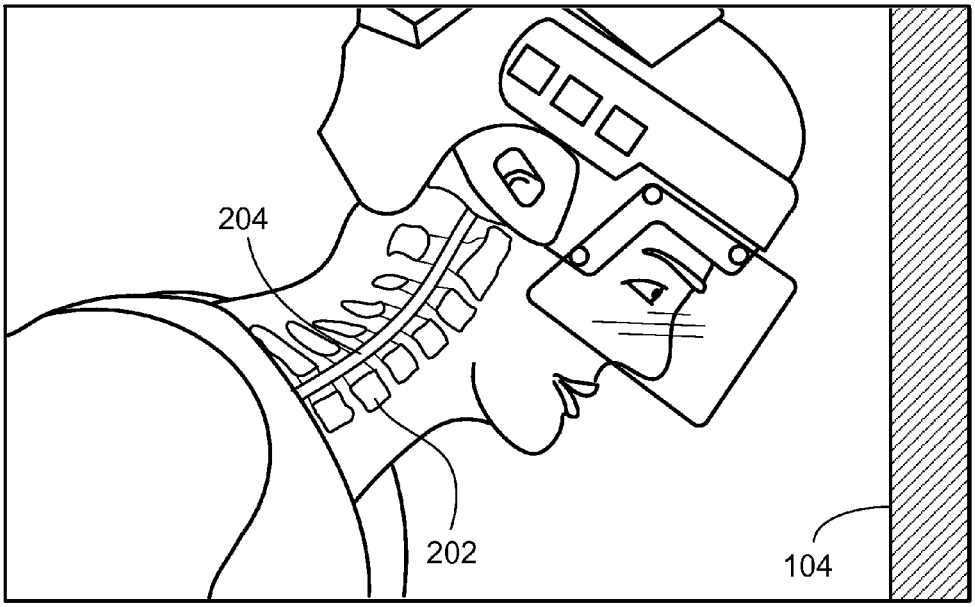
Figure 4C:
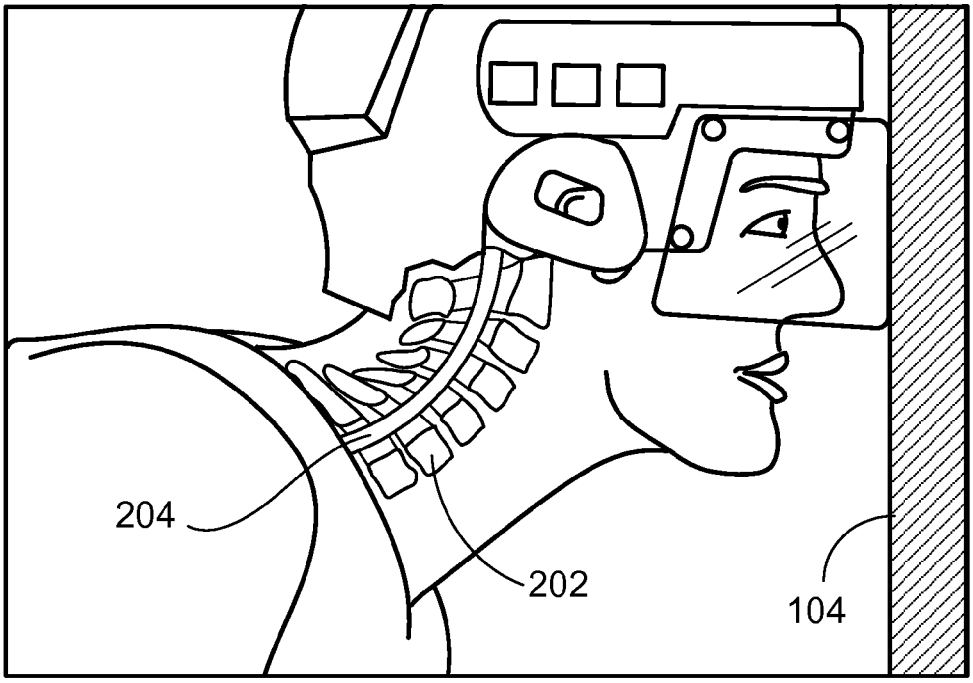

FIGS. 4A-4C schematically illustrate a hockey player travelling toward the wall 104 and then impacting the wall 104 in a face first manner, thereby avoiding serious injury. Referring to FIG. 4A, the hockey player is shown travelling head first toward the wall 104. This often occurs when players are checked from behind in the perimeter region 108 of the skating area 102. It can also occur as a result of being tripped or otherwise losing your footing in or near the perimeter region 108 of the skating area 102. As shown in FIG. 4B, as the hockey player approaches the wall 104, he or she sees the line 106, which prompts the player to look up. Referring to FIG. 4C, the player then impacts the wall 104 in a face first manner, which causes the player's neck to bend backward and absorb a significant amount of the force associated with the impact. Because the neck of the player bends backward when impacting the wall 104 in this way, compressive forces applied to the vertebra 202 as well as the other vertebrae of the player's spine are reduced as compared to the head first impact illustrated in FIG. 3B. As a result, the risk of a vertebra fracture, which can lead to damage to the spinal cord 204 and paralysis, is greatly reduced.

In addition to prompting players who are travelling toward the wall 104 in the perimeter region 108 of the skating area 102 to look up, the line 106 will help to ensure that all players more readily know when they and/or opposing players are within the perimeter region 108 of the skating area 102 near the wall 104. When a player sees an opposing player within the perimeter region 108 of the skating area 102, which includes the line 116, he or she will be reminded not to check the opposing player from behind or to otherwise act in a way that can cause the opposing player or himself/herself to impact the wall 104 head first.

To construct the skating rink 100 illustrated in FIGS. 1 and 2, a cement surface is created in the area over which the skating area 102 is to be located. Typically, an array of refrigerant conduits are formed within or positioned beneath the cement surface. The conduits are in fluid communication with a refrigerant pump that can pump liquid or gaseous refrigerant through the conduits to cool the cement surface to a temperature below freezing. The wall 102 is then erected around that area. Then, a sheet of plastic is laid over the cement surface and water (e.g., about one inch of water) is applied to the plastic sheet. The water is cooled by the cement surface, causing the water to freeze and form a base sheet of ice. The entire ice surface except for the surface region on which the line 106 is to be painted is then painted white. The line 106 is then applied along the perimeter region of the ice surface using orange paint. After the white and orange paint has dried, the various other markings discussed above are painted onto appropriate regions of the white and orange painted areas. After those painted markings have dried, more water (e.g., about ½ inch of water) is applied to the painted ice surface. This water freezes to form a top sheet of ice. This top sheet of ice provides the various markings with a layer of protection from skater's sharp skate blades.

While the line 116 has been illustrated as extending continuously around the entire perimeter region of the skating area 102, the line can alternatively be made up of a discontinuous series of markings that extend along the perimeter region 108 of the skating area 102. For example, the line can have a checkered design or can be made up of a series of spaced apart logos or emblems. In certain implementations, the line is made up of text. For example, the line can be made up of the phrase "Look Up" repeated a sufficient number of times along the perimeter region 108 of the skating area 102 to substantially surround the central region 110 of the skating area 102. Regardless of the specific design, the line acts as a clearly visible identifier of the perimeter region 108 of the skating area 102 near the wall 104.

While inner edge of the line 106 has been described as being located 30 inches to 42 inches from the wall 104, in certain implementations, the inner edge of the line is located farther from the wall 104. In the case of Olympic size skating rinks, for example, the distance between the wall 104 and the outer hash marks 152, 154, 156, 158 can be up to 132 inches. In such implementations, the inner edge of the line 106 can be at least 80 inches (e.g., 80 inches to 132 inches) from the wall.

While the line 116 has been illustrated as extending all the way to the wall 104, the line can alternatively be spaced inwardly from the wall 104. The outer edge of the line (i.e., the edge of the line nearest the wall 104) can, for example, be positioned 6 inches to 32 inches from the wall 104. In certain implementations, the line has a width of 10 inches to 40 inches.

While certain markings have been described as being applied as paint directly to the white base paint and the orange line paint on the base ice sheet, it should be understood that those markings can alternative be applied to a sheet of ice formed over the white base paint and orange line paint.

While the line 116 has been described as being formed of orange paint, paint of other colors can alternatively or additionally be used to form the line. In some implementations, the color(s) of the line differ(s) from the color of the various other markings on the skating area 102. Examples of other suitable colors that can be used to form the line include other shades of orange, yellow, and red. In cases in which the skating area 102 has a base color other than white, any of various other colors that provide contrast with the base color can be used for the line. Examples of suitable shades of yellow include Pantone 102C, Pantone 116C, Pantone 107C. Examples of suitable shades of red include Pantone 185C, Pantone 1788C, and Pantone 485C.

While the line 106 and the various other markings on the skating area 102 have been described as being painted onto the ice surface, other techniques can alternatively or additionally be used to create the line and/or the other markings. In certain implementations, for example, colored tape is applied to the ice surface to form the line and/or other markings. In certain implementations, colored lights (e.g., LEDs) are embedded within the ice to form the line and/or other markings.

While the line 116 has been described primarily with respect to hockey, the line 116 can also be beneficial to ice skating rinks used for various other purposes, such as speed skating, figure skating, recreational skating, etc.

The skating rink 100 discussed above uses water to form the ice of the skating area 102. However, other liquid solutions can alternatively or additionally be used to form the ice surface.

Skating rinks that use artificial ice, such as polymeric materials that can be skated on with traditional ice skates, can benefit from the various different versions of the line 106 described herein. In such cases, the line as well as various other markings can be applied to a base surface that underlies the polymeric skating surface. Alternatively, the line and other markings could be embedded within the polymeric surface.

The various different versions of the line 106 described herein can also be beneficially used on skating rinks that do not include ice of any form, including roller skating rinks, inline skating rinks, etc.

Other embodiments are within the scope of the following claims.

What is claimed is:

1. A skating rink, comprising:

a skating area having a perimeter region and a central region;

a wall at least partially surrounding the skating area;

a visible mark extending along the perimeter region of the skating area and substantially surrounding the central region, an inner edge of the visible mark being spaced inwardly from the wall by at least 12 inches to prompt a skater traveling head first toward the wall to look up; and a frozen liquid overlying the visible mark.

2. The skating rink of claim 1, wherein the frozen liquid overlies the entire skating area.

3. The skating rink of claim 2, wherein the skating area comprises a plurality of layers of the frozen liquid and the visible mark is positioned between adjacent layers of the frozen liquid.

4. The skating rink of claim 1, wherein the inner edge of the visible mark is spaced inwardly from the wall by 30 inches to 45 inches.

5. The skating rink of claim 1, wherein an outer edge of the visible mark is located no more than 35 inches from the wall.

6. The skating rink of claim 5, wherein the outer edge of the visible mark is located no more than 6 inches from the wall.

7. The skating rink of claim 1, wherein the visible mark has a width of 12 inches to 45 inches.

8. The skating rink of claim 1, wherein the visible mark is orange.

9. The skating rink of claim 8, wherein the visible mark has a color of Pantone 1505C, Pantone 151C, or Pantone 1585C.

10. The skating rink of claim 1, wherein the visible mark comprises a series of segments that are spaced apart about the perimeter region of the skating area.

11. The skating rink of claim 1, wherein the visible mark is in the form of a rectangle having rounded corners.

12. The skating rink of claim 1, wherein the visible mark comprises paint.

13. The skating rink of claim 1, wherein the visible mark comprises one or more logos.

14. The skating rink of claim 1, wherein the visible mark comprises text.

15. The skating rink of claim 14, wherein the text reads at least in part Look Up.

16. The skating rink of claim 1, wherein the skating area comprises a plurality of lines that overlap the visible mark, the plurality of lines being visible over the visible mark.

17. The skating rink of claim 16, wherein the skating area comprises a plurality of face off circles from which hash marks extend, the visible mark being positioned such that the visible mark does not overlap any portion of the plurality of face off circles or the hash marks.

18. A method of preparing a skating area of a skating rink, the method comprising:

applying a visible mark to a perimeter region of the skating area that substantially surrounds a central region of the skating area such that an inner edge of the visible mark is inwardly spaced from a wall surrounding the skating area by at least 12 inches to prompt a skater traveling head first toward the wall to look up; and applying liquid over the visible mark and freezing the liquid.

19. The method of claim 18, comprising applying the liquid over the entire skating area and freezing the liquid.

20. The method of claim 18, wherein the visible mark is colored mark.

21. The method of claim 18, wherein applying the visible mark to the perimeter region of the skating area comprises applying the visible mark to frozen liquid.

22. The method of claim 21, wherein applying the colored mark comprises painting frozen liquid.

23. The method of claim 18, wherein the inner edge of the visible mark is spaced inwardly from the wall by 30 inches to 45 inches.

24. The method of claim 18, wherein the visible mark has a width of 12 inches to 45 inches.

25. The method of claim 18, wherein the visible mark is orange.

26. The method of claim 25, wherein the visible mark has a color of Pantone 1505C, Pantone 151C, or Pantone 1585C.

27. The method of claim 18, wherein applying the visible mark to the perimeter region of the skating area comprises applying a series of segments to the perimeter region of the skating area, the segments being spaced apart about the perimeter region of the skating area.

28. The method of claim 18, wherein the visible mark comprises paint.

29. The method of claim 18, further comprising applying to the skating area a plurality of lines in a manner such that the plurality of lines overlap the visible mark and are visible over the visible mark.

30. The method of claim 29, further comprising applying to the skating area a plurality of face off circles from which hash marks extend, the visible mark being positioned such that the visible mark does not overlap any portion of the plurality of face off circles or the hash marks.

31. A skating rink, comprising:

a skating area having a perimeter region and a central region;

a wall at least partially surrounding the skating area; and a visible mark extending along the perimeter region of the skating area and substantially surrounding the central region, an inner edge of the visible mark being spaced inwardly from the wall by at least 12 inches to prompt a skater traveling head first toward the wall to look up;

wherein the skating area comprises a plurality of face off circles from which hash marks extend, the visible mark being positioned such that the visible mark does not overlap any portion of the plurality of face off circles or the hash marks.

32. A method of preparing a skating area of a skating rink, the method comprising:

applying a visible mark to a perimeter region of the skating area that substantially surrounds a central region of the skating area such that an inner edge of the visible mark is inwardly spaced from a wall surrounding the skating area by at least 12 inches to prompt a skater traveling head first toward the wall to look up; and applying to the skating area a plurality of face off circles from which hash marks extend, the visible mark being positioned such that the visible mark does not overlap any portion of the plurality of face off circles or the hash marks.

* * * * *